United States Patent [19]

Sugiyama

[11] Patent Number: 4,916,423

[45] Date of Patent: Apr. 10, 1990

[54] WATER COVER ARRANGEMENT FOR A SOLENOID APPARATUS

[75] Inventor: Takeshi Sugiyama, Himeji, Japan

[73] Assignee: Mitsubishi Denki Kabushiki Kaisha, Tokyo, Japan

[21] Appl. No.: 375,785

[22] Filed: Jul. 5, 1989

[30] Foreign Application Priority Data

Jul. 6, 1988 [JP] Japan ..... 63-168428

[51] Int. Cl.[4] ..... H01F 7/00

[52] U.S. Cl. ..... 335/278; 277/212 FB; 74/18.2

[58] Field of Search ..... 335/202, 278; 277/212 FB; 74/18, 18.1, 18.2

[56] References Cited

U.S. PATENT DOCUMENTS 4,535,998 8/1985 Katz ..... 277/212 FB
4,635,489 1/1987 Imamura et al. ..... 74/7

FOREIGN PATENT DOCUMENTS 2304042 8/1974 Fed. Rep. of Germany ..... 74/18.2
0156777 9/1983 Japan ..... 277/212 FB
0256706 11/1986 Japan ..... 335/278

*Primary Examiner*—George Harris
*Attorney, Agent, or Firm*—Sughrue, Mion, Zinn, Macpeak and Seas

[57] ABSTRACT

A solenoid apparatus comprising a solenoid case having an open end and a closed end, an electromagnetically movable plunger mounted in the solenoid case, and a substantially cup-shaped flexible-water-tight boot surrounding a plunger end portion projecting from the open end of the solenoid case and connected to the open end of the solenoid case, the flexible boot having a bottom wall central portion intimately secured to an end face of the plunger end portion. The flexible water-tight boot is provided with an air-vent hole which is closed when the plunger is outwardly extended from the solenoid case and which is opened when the plunger is retracted into the solenoid case due to the deformation of the flexible boot at its wall portion upon the movement of the plunger.

4 Claims, 2 Drawing Sheets

WATER COVER ARRANGEMENT FOR A SOLENOID APPARATUS

BACKGROUND OF THE INVENTION

This invention relates to a solenoid apparatus and more particularly to a water cover arrangement for a solenoid apparatus particularly suitable for use as a solenoid switch of an engine starter.

An engine starter usually comprises a solenoid switch which operates a shift lever for shifting a drive unit including a pinion gear and a unidirectional clutch slidably mounted on an output rotary shaft toward a ring gear of an engine and which connects an electric source to a d.c. motor for driving the pinion gear. The basic structure and the function of the solenoid switch are well known in the art.

A vehicular engine starter is installed in an engine compartment of a vehicle, so that splashed water often enters into the engine starter through an opening formed around the pinion gear. This is particularly true in the case of the off-road vehicles. Therefore, in order to prevent ingress of water into the end portion of the plunger projecting outwardly from the end portion of the solenoid case of the solenoid switch, a flexible water cover or a flexible water-proof boot attached between the plunger and the end portion of the solenoid case is proposed in, for example, Japanes Utility Model Laid-Open No. 60-113940.

However, if space between the plunger and the solenoid case is completely covered or air-tightly sealed by the boot and when the solenoid plunger is moved out of and into the solenoid case, an undesirable pressure difference generates between the outside and the inside of the boot, causing an unexpected deformation of the flexible boot which may generate cracks in the boot. In order to prevent this, conventional water proof boot is provided at its flexible wall with a small vent hole which provides communication between both sides of the boot through the boot wall. The previously mentioned Japanese U.M. Laid-Open discloses the provision of a vent hole extending through the end portion of the plunger from one side of the boot to the other side of the boot to establish a communication therebetween.

However, since the vent holes of the above conventional arrangements are designed to be kept always open, water splash can enter into the interior of the boot through the vent hole under severe conditions. This is a particularly serious problem when the solenoid switch must be installed at a relatively lower level in the engine compartment due to the limited space in the engine compartment, for example.

SUMMARY OF THE INVENTION

Accordingly, the chief object of the present invention is to provide a solenoid apparatus free from the above-discussed problems of the conventional design.

Another object of the present invention is to provide a solenoid apparatus having a water-proof flexible boot which prevent the generation of undesirable pressure difference between the inside and outside of the boot.

Another object of the present invention is to provide a solenoid apparatus having a water-proof flexible boot which is prevented from being damaged by an undesirable pressure difference between the inside and outside of the boot.

Another object of the present invention is to provide a solenoid apparatus having a water-proof flexible boot with a vent hole which opens when the plunger in the solenoid case is in the retracted position and closes when the plunger is in the extended position.

With the above objects in view, the solenoid apparatus of the present invention comprises a solenoid case having an open end and a substantially closed end, a plunger electromagnetically movably mounted in the solenoid case, and a substantially cup-shaped flexible water-tight boot surrounding a plunger end portion projecting from the solenoid case and connected to the open end of the solenoid case, the flexible boot having a bottom wall central portion intimately secured to an end face of the plunger end portion. The flexible water-tight boot is provided with an air-vent hole which is closed when the plunger is outwardly extended from the solenoid case and which is opened when the plunger is retracted into the solenoid case due to the deformation of the flexible boot at its wall portion upon the movement of the plunger.

In the preferred embodiment of the present invention, the vent hole has openings which open in the opposite wall surfaces, at least one of the wall surfaces defining the openings of the vent hole being arranged such that it is in an intimately contacting closing relationship with respect to the end face of the plunger end portion when the plunger is extended from the solenoid case and that it is in a separated opening relationship with respect to the end face of the plunger end portion when the plunger is retracted into the solenoid case. The opening defined by the one of the wall surfaces having a central axis slanted relative to the end face of the plunger end portion to extend in the direction radially outwardly toward the outer surface of the flexible boot.

In another embodiment of the present invention, the vent hole has a pair of valve vanes arranged such that they are in an intimately contacting closing relationship with respect to each other when the plunger is extended from the solenoid case and that they are in a separated opening relationship with respect to each other when the plunger is retracted into the solenoid case.

BRIEF DESCRIPTION OF THE DRAWINGS

The present invention will become more readily apparent from the following detailed description of the preferred embodiment of the present invention taken in conjunction with the acompanying drawings, in which.

DESCRIPTION OF THE PREFERRED EMBODIMENTS

Figure 1:
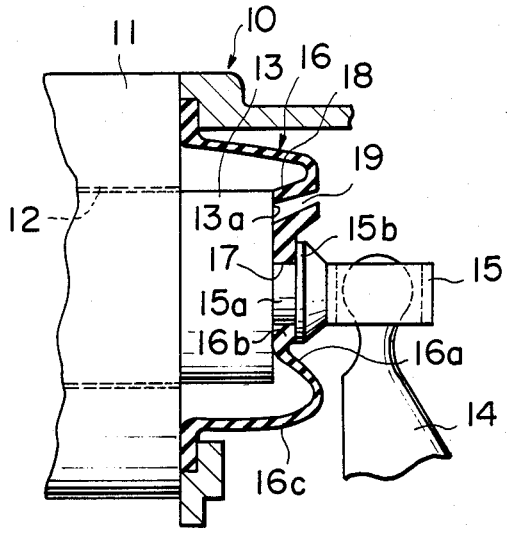
FIG. 1 is a fragmental sectional view illustrating a solenoid switch of an engine starter as one embodiment of the solenoid apparatus of the present invention, the vent hole being in the closed position.

FIG. 1 illustrates one embodiment of the solenoid apparatus with a flexible water cover arrangement of the present invention as being applied to a solenoid switch of an engine starter.

The solenoid switch 10 of this embodiment comprises a solenoid case 11 having an open end and a substantially closed end (not shown) and a plunger 13 axially movably disposed within an axial internal passage 12 of the solenoid case 11. The plunger 13 has an axially extending hook 15 at the central portion of one end of the plunger 13 projecting from the open end of the solenoid case 11 for engaging one end of a shift lever 14 for shifting a pinion or the like of the engine starter (not shown). The end portion of the plunger 13 is surrounded by a substantially cup-shaped boot 16 liquid-tightly attached at its open-end to the open end portion of the solenoid case 11. The boot is made of a flexible, water-proof material such as rubber and has a fluid-tight seal portion 16*b* which is an annular packing-like seal structure at the central portion of the bottom wall 16*a* of the cup-shaped boot 16. The seal portion 16 has a central opening 17 through which a stem portion 15*a* of the hook 15 extends and is held under a compressed state between the end face 13*a* of the plunger 13 and a flange 15*b* of the hook 15.

At the portion adjacent to the outer edge of the seal portion 16*b* of the boot, an increased-thickness portion 18 having a relatively large thickness substantially equal to that of the seal portion 16*b* for example is formed. The inner surface of the increased-thickness portion 18 is adapted to intimately contact with an outer portion of the end face 13*a* of the plunger 13 when the plunger 13 is in the extended position shown in FIG. 1. The increased-thickness portion 18 has a vent hole 19 extending therethrough, which has one end open at the inner surface of the thick portion 18 which intemately contacts with the plunger end face 13*a* and has the other end open at the outer surface of the thick portion 18. Thus, the vent hole 19 has one opening defined by the inner surface of the thick portion 18 and another opening defined by the outer surface of the thick portion 18. It is seen from FIG. 1 that the inner opening of the vent hole 19 which is defined by the inner surface of the thick portion 18 has a central central axis that is inclined relative to the end face of the plunger end portion to extend in the direction radially outwardly toward the outer surface of the flexible boot. In the illustrated embodiment, the vent hole 19 is inclined radially outwardly throughout its entire length as it extends from the inner to the outer ends. Thus, the vent hole 19 is closed at the inner end by the plunger end face 13*a* when the plunger 13 is in its extended position shown in FIG. 1.

The description will now be made as to the operation of the solenoid switch 10 of this embodiment.

Figure 2:
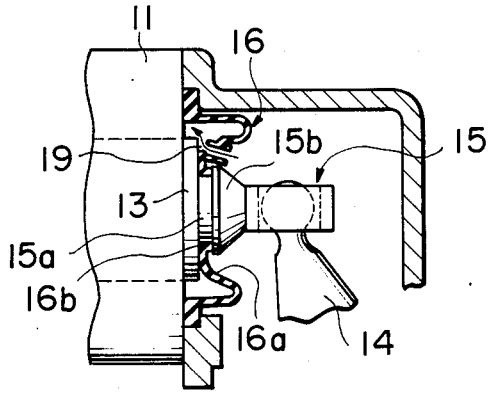
FIG. 2 is a fragmental sectional view similar to FIG. 1 but with the vent hole in the open position.

When an ignition switch of the engine (not shown) is turned on, an excitation coil (not shown) of the solenoid switch 10 is energized to generate a magnetic field which causes the plunger 13 to be magnetically moved along the internal passage 12 of the solenoid case 11 from the extended position shown in FIG. 1 to be retracted position shown in FIG. 2. Therefore, the hook 15 attached to the end portion of the plunger 13 moves the shift lever 14 counterclockwise to shift a pinion gear and the like (not shown) to a forward position to engage an engine ring gear (not shown). During this movement of the plunger 13 from the extended position of FIG. 1 to the retracted position of FIG. 2, the seal portion 16*b* of the bottom wall 16*a* of the cup-shaped flexible boot 16 is pulled leftward in the figures by the flange 15*b* of the hook 15, whereby the wall portion of the cup-shaped boot 16 extending from the outer edge of the seal portion 16*b* to the cylindrical side wall 16*c* deforms as shown in FIG. 2 in which the vent hole 19 reverses its direction of inclination and the inner surface of the thick portion 18 of the boot 16 defining the inner opening of the vent hole 19 separates from the end face 13*a* of the plunger 13 so that the interior space within the boot 16 is communicated with the exterior space of the boot 16. Therefore, there is no pressure difference generated between the interior space and the exterior space of the flexible boot 16.

After the engine is started, the plunger 13 returns to its original position shown in FIG. 1 owing to a return spring (not shown), whereby the inner opening of the vent hole 19 is closed again by the end face 13*a* of the plunger 13. Usually, water splash reaches the solenoid switch 10 only during the operation of the vehicle, so that it is sufficient for the purpose of preventing ingress of water into the boot 16 that the vent hole 19 is closed only when the solenoid switch 10 is deenergized.

Figure 3:
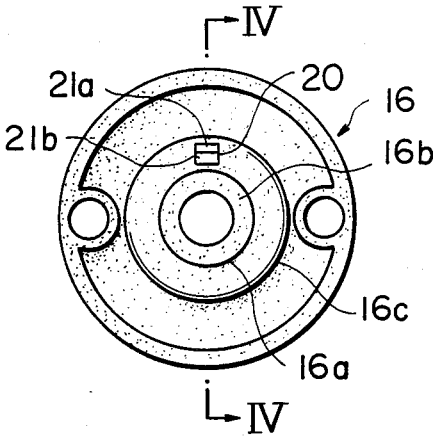
FIG. 3 is a plan view of the water-proof flexible boot employed in another embodiment of the present invention.
Figure 4:
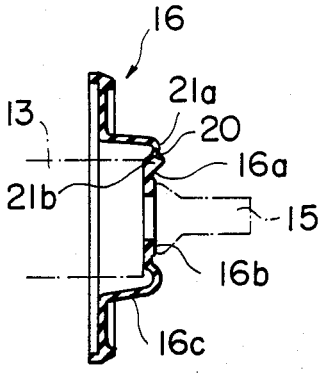
FIG. 4 is a sectional view of the water-proof flexible boot shown in FIG. 3, the vent hole being in the closed position.
Figure 5:
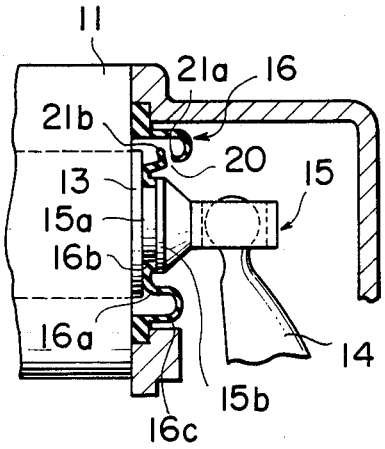
FIG. 5 is a fragmental sectional view illustrating the water-proof flexible boot shown in FIGS. 3 and 4 together with a solenoid switch of an engine starter, the vent hole being in the open position.

FIGS. 3 to 5 illustrate another embodiment of the solenoid apparatus of the present invention as applied to a solenoid switch of an engine starter. This embodiment has a different vent hole structure from that of the first embodiment.

In the water cover of the solenoid switch of this embodiment, in stead of the vent hole 19 shown in FIGS. 1 and 2, a relatively small rectangular opening 20 is formed at the wall portion of the flexible boot 16 connecting the bottom wall 16*a* and the cylindrical circumferential wall 16*c*. The opening 20 is provided with a pair of valve vanes 21*a* and 21*b* extending from opposite edges of the rectangular opening 20 toward each other so that a tip of one of the valves 21*a* or 21*b* elastically abuts against the surface of the other of the valves 21*b* or 21*a* to close the opening 20 when the plunger 13 is in its extended position shown in FIG. 4. These valve vanes 21*a* and 21*b* may be integrally formed flexible parts of the boot 16.

When the plunger 13 is moved into its retracted position shown in FIG. 5, the wall portion of the cup-shaped flexible boot 16 deforms and the valves 21*a* and 21*b* are separated to communicate the inside of the boot 16 with the outside of it as shown in FIG. 5 because the amount of deformation of the valve vane 21*b* is made greater than the amount of deformation of the valve vane 21*a* when the flexible boot 16 is deformed.

Thus, the vent hole structure 20 of this embodiment is self-closing structure in which the valves 21*a* and 21*b* close by themselves without the need for any other member. Therefore, the vent hole 20 need not be located at a position in which it can be brought into contact with the plunger end face 13*a*, for example, as in the case of the previous embodiment. It is to be noted that the vent hole 20 may be formed at any wall portion of the flexible cup-shaped boot 16 so long as the valves 21*a* and 21*b* of the vent hole 20 can be opened or closed by the deformation of the the flexible wall portion of the boot 16.

While the present invention has been described in conjunction with two embodiments in which the invention is applied to an solenoid switch of an engine starter, the present invention can equally be applied to a water-proof structure for the plunger end portion of a solenoid apparatus of other type in wich the plunger is moved relative to a solenoid case closed at one end .

As has been described above, according to the solenoid apparatus of the present invention, the flexible water-tight boot is provided with an air-vent hole which is closed when the plunger is outwardly extended from the open end of the solenoid case and which is opened when the plunger is retracted into the solenoid case due to the deformation of the flexible boot at its wall portion upon the movement of the plunger. Therefore, the generation of undesirable pressure difference between the inside and outside of the boot can be prevented while preventing the ingress of splashed water into the solenoid switch. Also, a water-proof flexible boot which is prevented from being damaged by an undesirable pressure difference between the inside and outside of the boot can be provided.

What is claimed is:

1. A solenoid apparatus comprising:

a solenoid case having an open end and a substantially closed end;

a plunger electromagnetically movably mounted in said solenoid case; and a substantially cup-shaped flexible water-tight boot surrounding a plunger end portion projecting from said solenoid case and connected to said open end of said solenoid case, said flexible boot having a bottom wall central portion intimately secured to an end face of said plunger end portion;

said flexible water-tight boot having a vent hole extending through its wall, said vent hole being closed when said plunger is outwardly extended from said solenoid case and being opened when said plunger is retracted into said solenoid case due to the deformation of said flexible boot at its wall portion upon the movement of said plunger.

2. A solenoid apparatus as claimed in claim 1, wherein said vent hole having openings which open in the opposite wall surfaces, at least one of said wall surfaces defining said openings of said vent hole being arranged such that it is in an intimately contacting closing relationship with respect to said end face of said plunger end portion when said plunger is extended from said solenoid case and that it is in a separated opening relationship with respect to said end face of said plunger end portion when said plunger is retracted into said solenoid case.

3. A solenoid apparatus as claimed in claim 2, wherein said opening defined by said one of said wall surfaces having a central axis slanted relative to said end face of said plunger end portion to extend in the direction radially outwardly toward the outer surface of said flexible boot.

4. A solenoid apparatus as claimed in claim 1, wherein said vent hole having a pair of valve vanes arranged such that they are in an intimately contacting closing relationship with respect to each other when said plunger is extended from said solenoid case and that they are in a separated opening relationship with respect to each other when said plunger is retracted into said solenoid case.

* * * * *